US008229332B2

(12) United States Patent
Mase

(10) Patent No.: US 8,229,332 B2
(45) Date of Patent: Jul. 24, 2012

(54) CARTRIDGE WITH SPIRAL BLADE AND IMAGE FORMING APPARATUS

(75) Inventor: Soichiro Mase, Handa (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 719 days.

(21) Appl. No.: 12/056,875

(22) Filed: Mar. 27, 2008

(65) Prior Publication Data

US 2008/0240775 A1 Oct. 2, 2008

(30) Foreign Application Priority Data

Mar. 27, 2007 (JP) ..... 2007-082213

(51) Int. Cl.
*G03G 15/08* (2006.01)

(52) U.S. Cl. ..... 399/263; 399/256

(58) Field of Classification Search ..... 399/119, 399/253, 254, 263
See application file for complete search history.

(56) References Cited

U.S. PATENT DOCUMENTS

| | | | | |
|---|---|---|---|---|
| 4,026,241 | A * | 5/1977 | Takebe et al. | 399/256 |
| 5,134,441 | A * | 7/1992 | Nagata et al. | 399/103 |
| 2006/0188273 | A1 * | 8/2006 | Takesawa et al. | 399/27 |

FOREIGN PATENT DOCUMENTS

| | | | |
|---|---|---|---|
| JP | H05-107908 | A | 4/1993 |
| JP | H06-004175 | U | 1/1994 |
| JP | 08-137224 | | 5/1996 |
| JP | 09-319202 | | 12/1997 |
| JP | 10-307521 | | 11/1998 |
| JP | 2002-108160 | A | 4/2002 |
| JP | 2004157439 | A * | 6/2004 |
| JP | 2007-010921 | | 1/2007 |
| JP | 2008026697 | A * | 2/2008 |

OTHER PUBLICATIONS

Notification of Reasons for Refusal for corresponding Japanese Patent Application 2007-082213 mailed on Sep. 27, 2011.
JP Decision of Patent Grant mailed Mar. 13, 2012, JP Appln. 2007-082213, English translation.

* cited by examiner

*Primary Examiner* — David Gray
*Assistant Examiner* — Billy J Lactaoen
(74) *Attorney, Agent, or Firm* — Banner & Witcoff, Ltd.

(57) ABSTRACT

A cartridge, an auger, and an image forming apparatus are provided. The cartridge includes a housing including supporting members and a conveying member, at least a portion of the conveying member rotating in an eccentric manner, the conveying member including a main body portion; a pair of supported portions provided at both ends of the main body portion and rotatably supported by the supporting members; and a spiral blade portion that conveys developer. The image forming apparatus includes an image forming apparatus main body including the cartridge. The auger includes a cylindrical main body comprising a spiral blade portion that conveys developer and shaft portions having rotational centers that coincide with each other, one of the shaft portions provided at each end of the main body, a center of gravity of the main body being displaced from the rotational centers of the shaft portions.

16 Claims, 10 Drawing Sheets

CARTRIDGE WITH SPIRAL BLADE AND IMAGE FORMING APPARATUS

CROSS-REFERENCE TO RELATED APPLICATIONS

This application claims priority from Japanese Patent Application No. 2007-082213 filed on Mar. 27, 2007, the entire subject matter of which is incorporated herein by reference.

TECHNICAL FIELD

Aspects of the present invention relate to an image forming apparatus and a cartridge for installation in an image forming apparatus.

BACKGROUND

There has been proposed an image forming apparatus such as a laser printer, in which a cartridge includes a conveying member that rotates to convey developer in an axial direction.

For example, JP-A-9-319202 describes a cartridge in a developing device in which a toner supply opening and a toner suction opening are formed at both sides of a developing chamber having a developing roller provided therein. In addition, a related art auger member having spiral teeth is provided in the vicinity of the toner supply opening and the toner suction opening. The related art auger member is configured to supply the toner supplied from the toner supply opening to the inside of the developing chamber close to the developing roller and to convey the toner to the toner suction opening, by means of the rotation of the spiral teeth.

SUMMARY

Aspects of the present invention provide a cartridge capable of suppressing deterioration in the performance of a conveying member which conveys developer, and also to provide an image forming apparatus in which the cartridge is installed.

DETAILED DESCRIPTION

<General Overview>

Figure 1:
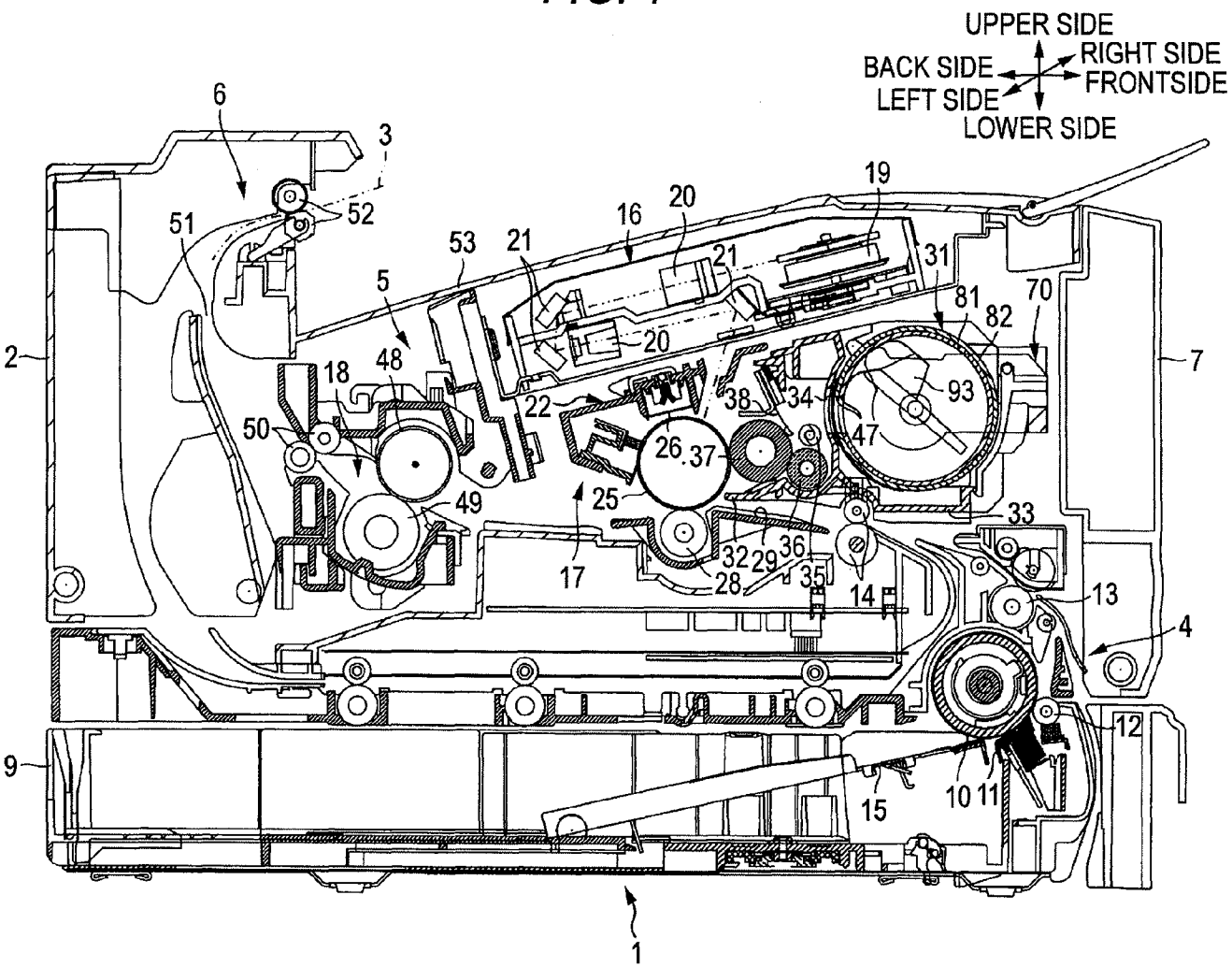
FIG. 1 is a side sectional view illustrating an image forming apparatus according to an illustrative aspect of the present invention.

According to an aspect of the present invention, there is provided a cartridge including: a housing that is capable of accommodating developer and that has a pair of supporting members confronting each other in a first direction with a gap therebetween; and a conveying member provided in the housing, at least a portion of the conveying member rotating in an eccentric manner, the conveying member including: a main body portion disposed along the first direction; a pair of supported portions that are provided at both ends of the main body portion in the first direction and are rotatably supported by the supporting members; and a spiral blade portion that is provided on the main body portion and that conveys the developer in the first direction.

According to another aspect of the present invention, there is provided an image forming apparatus, including: an image forming apparatus main body including: a cartridge including a housing that is capable of accommodating developer and that has a pair of supporting members confronting each other in a first direction with a gap therebetween; and a conveying member provided in the housing, at least a portion of the conveying member rotating in an eccentric manner, the conveying member including: a main body portion disposed along the first direction; a pair of supported portions that are provided at both ends of the main body portion in the first direction and are rotatably supported by the supporting members; and a spiral blade portion that is provided on the main body portion and that conveys the developer in the first direction.

According to another aspect of the present invention, there is provided an auger for circulating developer, the auger including: a cylindrical main body including a spiral blade portion that conveys the developer along a longitudinal axis of the cylindrical main body; and a pair of shaft portions having rotational centers that coincide with each other, one of the pair of shaft portions provided at each end of the cylindrical main body, a center of gravity of the cylindrical main body being displaced from the rotational centers of the pair of shaft portions such that at least a portion of the auger rotates in an eccentric manner.

According to another aspect of the present invention, there is provided an auger for circulating developer, the auger including: a cylindrical main body including a spiral blade portion that conveys the developer along a longitudinal axis of the cylindrical main body; and means for rotating at least a portion of the cylindrical main body in an eccentric manner.

<Illustrative Aspects>

Illustrative aspects of the invention will be described with reference to the drawings.

In the related art auger member described in JP-A-9-319202, the gap between the spiral teeth is generally narrowed in order to improve the performance of conveying the toner. However, in such a case, the toner can easily get blocked between adjacent teeth, thus deteriorating the performance of conveying the toner contrary to the expectation.

Aspects of the present invention provide a cartridge capable of suppressing deterioration in the performance of a conveying member which conveys developer, and also to provide an image forming apparatus in which the cartridge is installed.

(Image Forming Apparatus)

Figure 2:
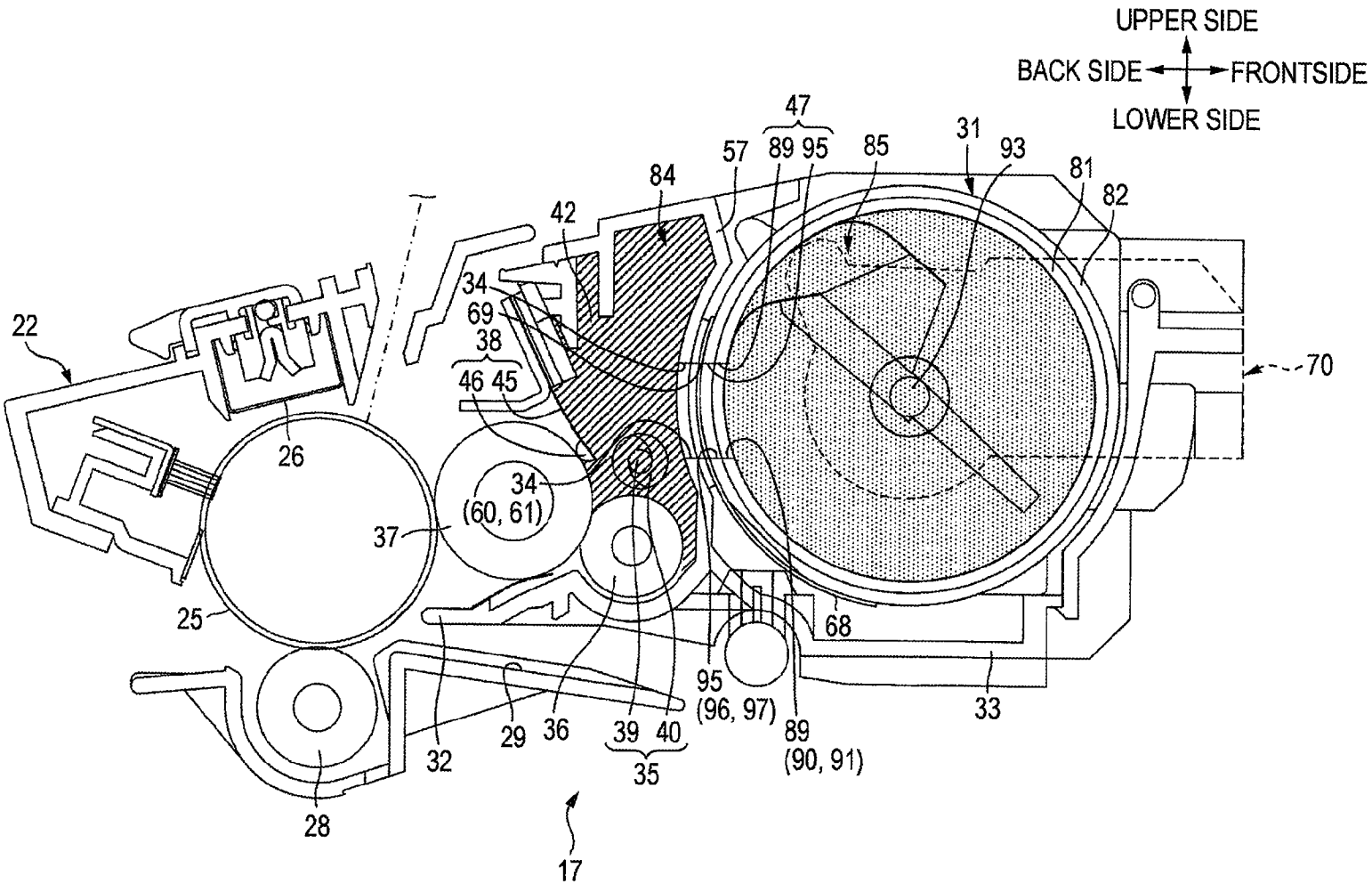
FIG. 2 is an exemplary side sectional view of a cartridge, according to another illustrative aspect of the present invention, of the image forming apparatus of FIG. 1.
Figure 3:
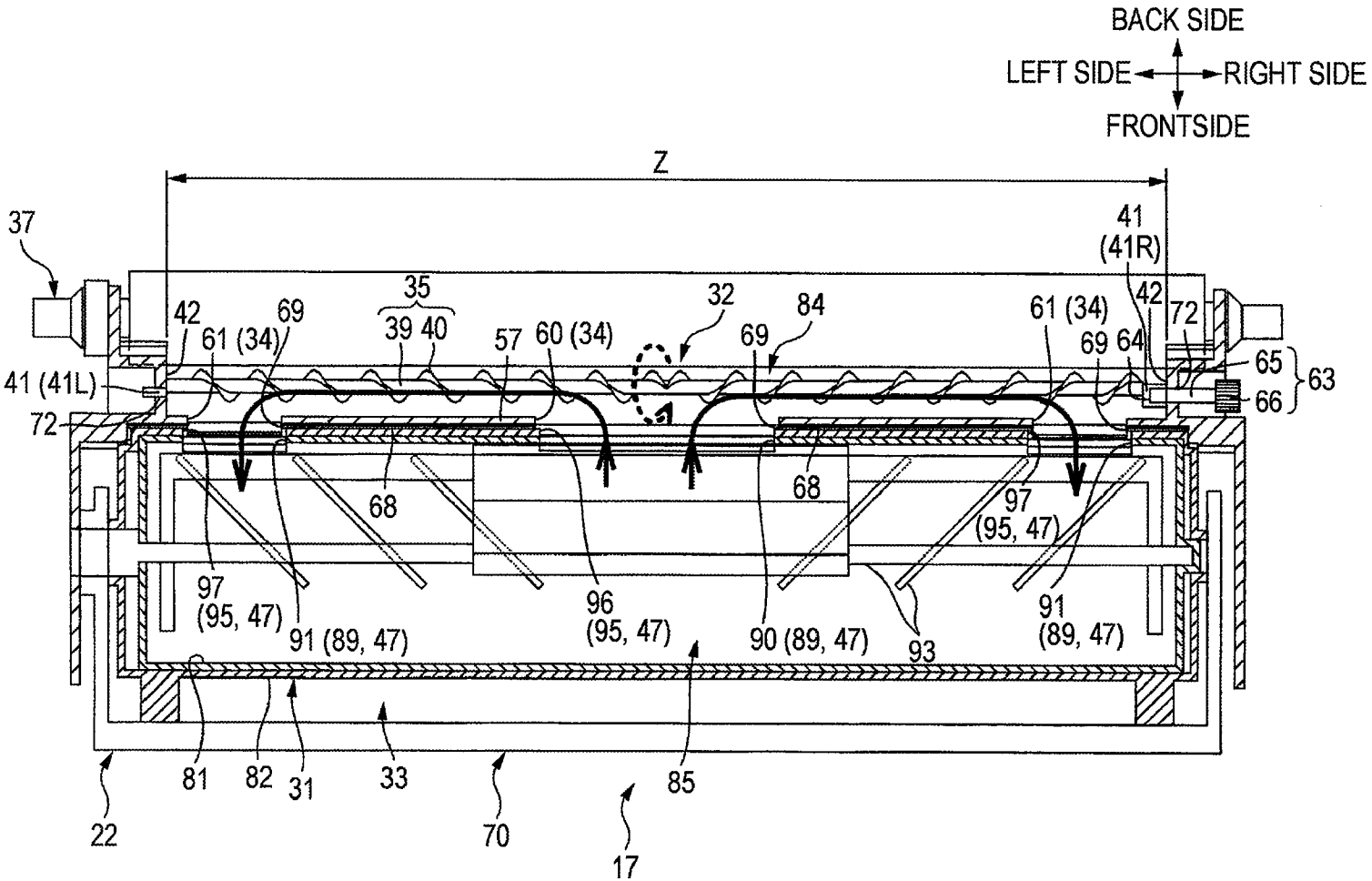
FIG. 3 is a schematic top sectional view of the cartridge of FIG. 2.
Figure 4:
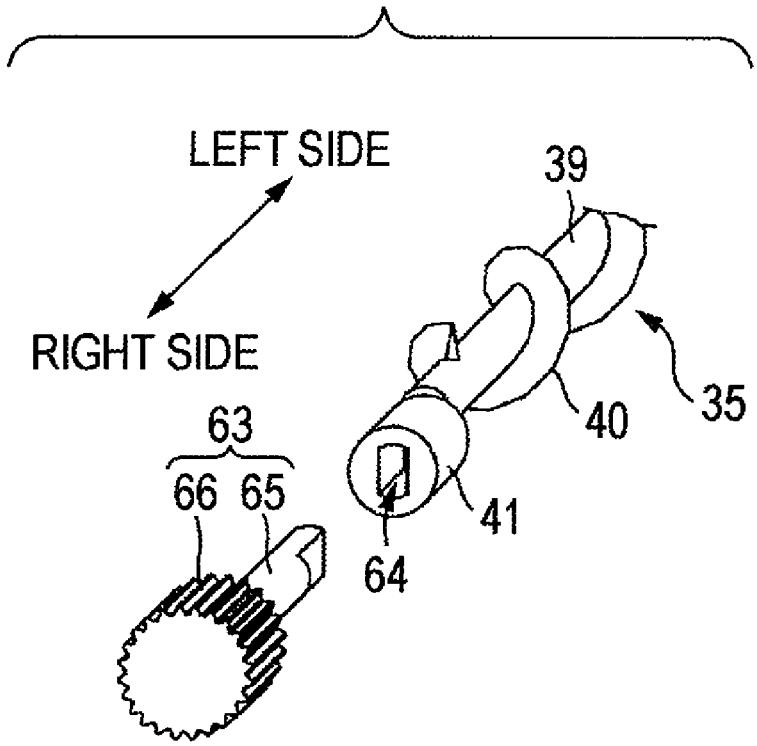
FIG. 4 is a schematic perspective view of an auger, according to another illustrative aspect of the present invention, of the cartridge of FIGS. 2 and 3.

FIG. 1 is an exemplary side sectional view illustrating an image forming apparatus according to an illustrative aspect of the present invention. In FIG. 1, the image forming apparatus is embodied in the form of a laser printer by way of an example. However, one of ordinary skill in the art will appreciate that the present inventive concept will apply equally to any apparatus which uses developer for producing images on a recording medium. FIG. 2 is an exemplary side sectional view of a cartridge, according to another illustrative aspect of the present invention, of the image forming apparatus. FIG. 3 is a schematic top sectional view of the cartridge. FIG. 4 is a schematic perspective view of an auger, according to another illustrative aspect of the present invention, of the cartridge.

As shown in FIG. 1, within a body casing 2 as an example of an image forming apparatus main body, the image forming apparatus 1 includes a feeder unit 4 for feeding a sheet 3, an image forming unit 5 for forming an image on the fed sheet 3, and a sheet discharge part 6 for discharging the image-formed sheet 3.

(1) Main Body Casing

The body casing 2 has a substantially box shape. An opening is formed in a side wall at one side thereof, and a front cover 7 is provided for opening and closing the opening. By opening the front cover 7, the body casing 2 can be attached or detached to or from a cartridge 17 (described in more detail later).

Incidentally, in the following description, a side (right side in FIG. 1) where the front cover 7 is provided is referred to as a front side (front face side) and an opposite side (left side in FIG. 1) is referred to as a back side (rear side). A proximal side of FIG. 1 in a widthwise direction of a sheet is referred to as a left side, and a distal side of FIG. 1 in the widthwise direction of the sheet is referred to as a right side. A horizontal direction is synonymous with a widthwise direction.

(2) Feeder Unit

The feeder unit 4 includes a sheet feeding tray 9, a sheet feeding roller 10, a sheet feeding pad 11, sheet powder removing rollers 12 and 13, a register roller 14, and a sheet pressing plate 15. The sheet 3 on top of the sheet pressing plate 15 is fed by the sheet feeding roller 10 and the sheet feeding pad 11 and is passed through various rollers 12 to 14, and is thereafter conveyed to a transfer position (described later) of the image forming unit 5. The sheets 3 are fed one at a time from the top of the sheet pressing plate 15.

(3) Image Forming Unit

The image forming unit 5 includes a scanner unit 16, a cartridge 17, and a fixing part 18. In FIG. 1, the cartridge 17 is embodied in the form of a process cartridge by way of an example. However, one of ordinary skill in the art will appreciate that the present inventive concept will apply equally to any similar cartridge unit.

(3-1) Scanner Unit

The scanner unit 16 is provided in an upper portion within the body casing 2, and includes a laser emitting portion (not shown), a rotating polygon mirror 19, a plurality of lenses 20, and a plurality of reflective mirrors 21. As denoted by the chained line, laser beams emitted from the laser emitting portion based on image data are reflected from the polygon mirror 19 and then selectively passed through or reflected from the plurality of lenses 20 and the plurality of reflective mirrors 21, and are finally scanned onto the surface of a photosensitive drum 25 (described later), which is an example of a photosensitive member of the cartridge 17.

(3-2) Cartridge

The cartridge 17 is disposed under the scanner unit 16 within the body casing 2 and is detachably attached to the body casing 2.

As shown in FIG. 2, the cartridge 17 includes a process frame 22 having a substantially box shape, in which a transfer path 29 is formed allowing the passage of the sheet 3, and a toner cartridge 31 detachably attached to a cartridge receiving part 33 of the process frame 22. The process frame 22 serves as an example of a first housing, and the toner cartridge 31 serves as an example of a second housing. Both the process frame 22 and the toner cartridge collectively serve as an example of a housing.

Both side walls of the process frame 22 in the width direction will be referred to as process side walls 42. The two process side walls 42 extend in parallel directions while being disposed opposite each other in the width direction. Between the process side walls 42, a partition wall 57 extending in the up-down direction is provided substantially at the central position in the front-rear direction. In the process frame 22, the rear-side portion of the partition wall 57 constitutes a developing portion 32, and the front-side portion of the partition wall 57 constitutes the cartridge receiving part 33 described above. A frame-side passage opening 34 is formed in the partition wall 57. Specifically, three frame-side passage openings 34 are provided with gaps therebetween in the width direction (see FIG. 3). In the following description, the frame-side passage opening 34 at the center in the width direction will be referred to as a frame-side supply opening 60, and the frame-side passage openings 34 at both sides of the frame-side supply opening 60 in the width direction will be referred to as frame-side return openings 61, as best seen in FIG. 3.

The process frame 22 includes the photosensitive drum 25, a scorotron-type charger 26, a transfer roller 28, an auger 35 as an example of a conveying member, a supply roller 36, a developing roller 37 as an example of a developer carrying member, and a layer-thickness restricting blade 38 are arranged.

The photosensitive member 25 is supported by the process side walls 42 in a freely rotatable manner. The scorotron-type charger 26 is disposed at a distance above the photosensitive drum 25 and is supported on the top wall of the process frame 22.

The transfer roller 28 is disposed under the photosensitive drum 25 in an opposing relationship and is supported by the process side walls 42 in a freely rotatable manner.

The developing roller 37 is disposed on the front side of the photosensitive drum 25 in an opposing relationship. The supply roller 36 is disposed on the front side of developing roller 37 in an opposing relationship. The developing roller 37 and the supply roller 36 have substantially the same size in the width direction and are supported by the process side walls 42 in a freely rotatable manner. The frame-side supply opening 60 is located substantially at the center of the supply roller 36 in the width direction, and the size in the width direction is smaller than the size of the supply roller 36 in the width direction.

The layer-thickness restricting blade 38 includes a plate spring member 45 having a substantially thin plate shape and a pressure-contact rubber 46 provided at the lower end portion of the plate spring member 45. The upper end portion of the plate spring member 45 is fixed to the top wall of the process frame 22. The pressure-contact rubber 46 presses the surface of the developing roller 37 by the elastic force of the plate spring member 45.

In the following descriptions, a space (a hatched area in FIG. 2) within the developing portion 32 surrounded by the partition wall 57, the top wall of the process frame 22, the process side walls 42, the layer-thickness restricting blade 38, the supply roller 36, and the developing roller 37 will be referred to as a developing chamber 84, which is an example of a first chamber formed in the process frame 22.

The auger 35 is provided in the developing chamber 84, and is disposed on the rear side of the frame-side passage openings 34 and above the supply roller 36 in an opposing relationship with the frame-side passage openings 34.

As shown in FIG. 3, the auger 35 integrally includes an auger main body 39 having a substantially cylindrical column shape that is long in the width direction, a screw 40 provided around the auger main body 39, and auger shafts 41 provided at both ends of the auger main body 39 in the width direction. An auger gear 63 is detachably attached to a right-side auger shaft 41.

The auger main body 39 serves as an example of a main body portion and extends along the width direction. The auger main body 39 and the supply roller 36 have substantially the same size in the width direction. The frame-side supply opening 60 is located at a position substantially corresponding to the center of the auger main body 39 in the width direction, and the frame-side return openings 61 are located in the vicinity of the both ends of the auger main body 39 in the width direction.

The screw 40 serves as an example of a blade portion, which is a thin plate that extends in the width direction and winds around the auger main body 39 in a spiral shape (the thin plate also referred to as a tooth). The winding direction changes to a reversed direction at the center of the auger main body 39 in the width direction.

The auger shafts 41 serve as an example of a supported portion. The diameter of a right-side auger shaft 41 is larger than the diameter of a left-side auger shaft 41. As shown in FIG. 4, the right section of the right-side auger shaft 41 is depressed toward the left side at the axially central position to form a connecting concave portion 64 having a substantially rectangular shape when seen from the right side. The auger gear 63 integrally includes a gear shaft 65 substantially having a substantially cylindrical column shape that is long in the width direction, and a gear portion 66 provided at the right end portion of the gear shaft 65 and having a diameter greater than that of the gear shaft 65. Gear teeth are formed around the circumferential surface of the gear portion 66. The left section at the left end portion of the gear shaft 65 has a substantially rectangular shape substantially the same as that of the connecting concave portion 64.

As shown in FIG. 3, each of the process side walls 42 includes a corresponding support hole 72 having a substantially annular shape when seen in the width direction. The left-side auger shaft 41 is inserted through the left-side support hole 72 from the inner side (the right side) of the left-side process side wall 42. The left-side auger shaft 41 is supported by the process side wall 42 in a freely rotatable manner. The gear shaft 65 is inserted through the right-side support hole 72 from the outer side (the right side) of the right-side process side wall 42, and the left end portion of the gear shaft 65 is inserted into the connecting concave portion 64. The right-side auger shaft 41 and the auger gear 63 are supported by the process side wall 42 in a freely rotatable manner. Accordingly, the auger 35 can be supported by the two process side walls 42 in a freely rotatable manner about respective auger shafts 41. The gear portion 66 engages with a gear of a motor (not shown) of the body casing 2 to receive the driving force of the motor. Thus, the auger 35 rotates in the counterclockwise direction (see the broken-line arrow in the drawing) when seen from the right side. In this state, the left section of the auger main body 39 is in contact with the right-side surface of the left-side process side wall 42, and the right section of the right-side auger shaft 41 is in contact with the left-side surface of the right-side process sidewall 42. That is, the auger main body 39 and the right-side auger shaft 41 are sandwiched between the two process side walls 42. The two process side walls 42 are opposed to each other at portions where the support holes 72 are formed, with a gap (referred to as an opposing gap Z) between the process side walls 42. The gap may be predetermined. The portions of the process side walls 42 where the support holes 72 are formed serve as an example of a supporting portion. Details of the auger 35 will be described later.

As shown in FIG. 2, the cartridge receiving part 33 is provided with a shutter 68 and swing arm 70. The shutter 68 can move in the vertical direction to the partition wall 57 in a sliding manner. The shutter 68 is provided with three shutter opening portions 69 opposed to the frame-side passage openings 34 in a corresponding manner (see FIG. 3). When the shutter 68 moves downward, the frame-side passage openings 34 are opened opposite the corresponding shutter opening portions 69. On the other hand, when the shutter 68 moves upward, the frame-side passage openings 34 are closed by being released from the respective opposing states to the shutter opening portions 69. The swing arm 70 is supported by the cartridge receiving part 33 in a freely swingable manner. The swing arm 70 is operated, for example, when the cartridge 17 is attached to or detached from the body casing 2.

The toner cartridge 31 is detachably attached to the process frame 22 in the cartridge receiving part 33. The toner cartridge 31 has a double-housing structure that includes an inside housing 81 having a substantially hollow cylindrical shape and an outside housing 82 having a substantially hollow cylindrical shape. An outer passage opening 95 is formed in a circumferential wall of the outside housing 82. Specifically, three outer passage openings 95 are provided with gaps therebetween in the width direction. In the following description, the outer passage opening 95 at the center in the width direction will be referred to as an outer supply opening 96, and the outer passage openings 95 at both sides of the outer supply opening 96 in the width direction will be referred to as outer return openings 97 (see FIG. 3). An inner passage opening 89 is formed in a circumferential wall of the inside housing 81. Specifically, three inner passage openings 89 are provided with gaps therebetween in the width direction. In the following descriptions, the inner passage opening 89 at the center in the width direction will be referred to as an inner supply opening 90, and the inner passage openings 89 at both sides of the inner supply opening 90 in the width direction will be referred to as inner return openings 91 (see FIG. 3). The outer passage openings 95 and the inner passage openings 89 are also collectively referred to as a cartridge-side passage opening 47. The inside housing 81 can rotate between an open position and a closed position with respect to the outside housing 82. When the inside housing 81 is at the open position, the inner supply opening 90 and the outer supply opening 96 communicate with each other, and the inner return opening 91 and the outer return opening 97 communicate with each other (see FIG. 3). On the other hand, when the inside housing 81 is at the closed position, the communication state of the inner supply opening 90 and the outer supply opening 96 is released, and the communication state of the inner return opening 91 and the outer return opening 97 is released (not shown).

Within the inside housing 81 (a space surrounded by the chained line in FIG. 2 and will be referred to as a chamber 85 formed in the toner cartridge 31, as an example of a second chamber), a nonmagnetic, mono-component, positively-charged toner is accommodated, and an agitator 93 is provided in a freely rotatable manner. The above-described developing chamber 84 is less spacious than the chamber 85.

When the above-described swing arm 70 is swung upward in a state that the toner cartridge 31 is received in the toner cartridge receiving part 33, the shutter 68 is moved downward in response to the swing to open the frame-side passage openings 34 so that the inside housing 81 is rotated to the open position. Thus, the cartridge-side passage openings 47 and the frame-side passage openings 34 communicate with each other. Specifically, the inner supply opening 90 and the frame-side supply opening 60 communicate with each other, and the inner return opening 91 and the frame-side return opening 61 communicate with each other (see FIG. 3). On the other hand, when the swing arm 70 is swung downward from this state, the shutter 68 is moved upward in response to the swing to close the frame-side passage openings 34 so that the inside housing 81 is rotated to the closed position. Thus, the communication state of the cartridge-side passage openings 47 and the frame-side passage openings 34 is released (not shown).

As shown in FIG. 3, in the state in which the cartridge-side passage openings 47 and the frame-side passage openings 34 communicate with each other, the toner accommodated in the chamber 85 of the toner cartridge 31 is agitated by the rotation of the agitator 93. The toner is supplied to the frame-side passage openings 34 (the frame-side supply opening 60) from the cartridge-side passage openings 47 (the inner supply opening 90 and the outer supply opening 96) and is then supplied to the developing chamber 84 of the developing portion 32. The supplied toner is then supplied to the supply roller 36 while being received in spaces between teeth of the screw 40 of the auger 35 and conveyed by the screw 40 of the rotating auger 35 from the center in the width direction toward both sides in the width direction (see the bold-line arrow in the drawing). A portion of the toner is returned to the inside of the chamber 85 of the toner cartridge 31 via the frame-side passage openings 34 (the frame-side return opening 61) and the cartridge-side passage openings 47 (the inner return opening 91 and the outer return opening 97). Thus, it is possible to secure circulation of the toner between the toner cartridge 31 and the developing portion 32 of the process frame 22. As described above, the size of the frame-side supply opening 60 in the width direction is smaller than the size of the supply roller 36 in the width direction. Thus, it is not possible to supply the toner from the frame-side supply opening 60 to the entire surface in the width direction of the supply roller 36 at a time. However, by using the auger 35, it is possible to supply the toner from the frame-side supply opening 60 to the entire surface in the width direction of the supply roller 36 in a uniform manner.

As shown in FIG. 2, the toner supplied to the supply roller 36 is supplied to the developing roller 37 by the rotation of the supply roller 36. The toner is positively charged by friction while being rubbed between the supply roller 36 and the developing roller 37. Subsequently, as the developing roller 37 rotates, the toner is moved between the pressure-contact rubber 46 and the developing roller 37, where the thickness of the toner layer is restricted, and a thin toner layer is then carried on the surface of the developing roller 37.

As the photosensitive drum 25 rotates, the surface of the photosensitive drum 25 is first positively charged by the scorotron-type charger 26 in a uniform manner, and is then exposed by the laser beams (see the chained line in the drawing) from the scanner unit 16 so that an electrostatic latent image based on image data is formed on the surface of the photosensitive drum 25. Then, when the toner carried on the surface of the developing roller 37 is brought into opposing contact with the photosensitive drum 25 by the rotation of the developing roller 37, the toner carried on the surface of the developing roller 37 is supplied to the electrostatic latent image formed on the surface of the photosensitive drum 25. Accordingly, the electrostatic latent image is developed (changed to a visible image), and toner image is carried on the surface of the photosensitive drum 25. This toner image is transferred onto the sheet 3 conveyed to a position (a transfer position) between the photosensitive drum 25 and the transfer roller 28 in the transfer path 29.

(3-3) Fixing Part

As shown in FIG. 1, the fixing part 18 is provided on the rear side of the cartridge 17. The fixing part 18 includes a heating roller 48, a pressure roller 49 disposed under the heating roller 48 so as to make pressure contact with the heating roller 48, and a pair of conveying rollers 50 disposed on the rear side of the heating roller 48 and the pressure roller 49.

In the fixing part 18, the toner transferred onto the sheet 3 at the transfer position is thermally fixed during the passage of the sheet 3 between the heating roller 48 and the pressure roller 49. Thereafter, the sheet 3 is conveyed to the sheet discharge part 6 by the conveying rollers 50.

(4) Sheet Discharge Part

The sheet discharge part 6 includes a sheet discharge path 51, a sheet discharge roller 52, and a sheet discharge tray 53. The sheet conveyed from the fixing part 18 to the sheet discharge path 51 is conveyed from the sheet discharge path 51 to the sheet discharge roller 52 and is then discharged onto the sheet discharge tray 53 by the sheet discharge roller 52.

(Auger)

Figure 5A:
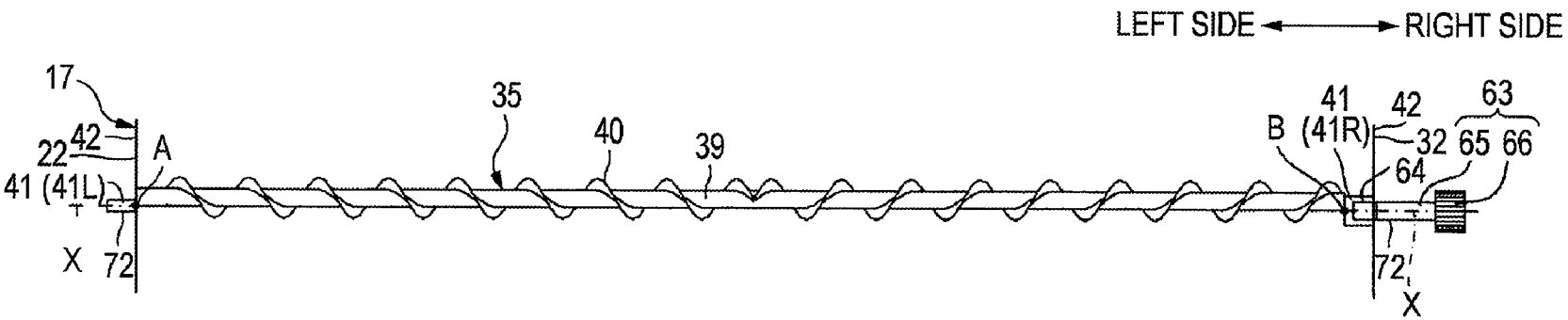
FIG. 5A is a schematic top view of process side walls and the auger.
Figure 5B:
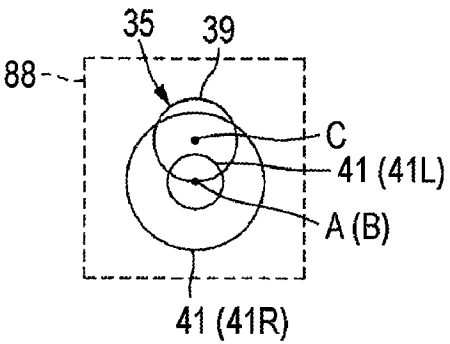
FIG. 5B is a projection view, projected in a width direction, of the auger shown in FIG. 5A.

FIG. 5A is a top view of the process side walls 42 and the auger 35, and FIG. 5B is a projection view of the auger 35 shown in FIG. 5A, projected in the width direction.

As shown in FIG. 5A, the support holes 72 are opposite to each other in the width direction, and the circular centers of the auger shafts 41 are also opposite to each other in the width direction. In such a state, the rotation axis X of the auger 35 passes through the circular centers (the rotational center) of the auger shafts 41 and extends parallel to the width direction. On the other hand, the auger main body 39 is connected to the auger shafts 41 with the circular center (the center of gravity) thereof being disposed at a position displaced from the circular centers of the auger shafts 41, i.e., displaced from the rotation axis X.

For the sake of explanation, the rotational center of the left-side auger shaft 41 (denoted as an auger shaft 41L) will be referred to as A; the rotational center of the right-side auger shaft 41 (denoted as an auger shaft 41R) will be referred to as B; and the center of gravity of the auger main body 39 will be referred to as C. To more specifically describe the above-described disposition relationship, as shown in FIG. 5B, in the projection plane 88 of the process side walls 42 projected in the opposing direction (the width direction), the rotational centers A and B of the auger shafts 41 coincide with each other and are displaced from the center of gravity C of the auger main body 39. Accordingly, when seen from a direction (the front-rear direction or the up-down direction) perpendicular to the width direction, the auger 35 has a substantially inverted C shape (see FIG. 5A).

When the auger 35 rotates, a portion of the auger 35, i.e., the auger main body 39 (including the screw 40) rotates about the rotation axis X in an eccentric manner.

As shown in FIG. 5A, the auger 35 includes the auger main body 39 disposed along the opposing direction (the width direction) of the process side walls 42, the auger shafts 41 provided at both ends of the auger main body 39 in the width direction and supported by the respective process side walls 42 in a freely rotatable manner, and the spiral screw 40 provided on the auger main body 39 to convey the toner in the width direction. The auger 35 rotates about the rotation axis X that connects the rotational centers A and B of the auger shafts 41 to each other and conveys the toner in the width direction with the toner received between adjacent teeth of the screw 40.

As described above, since at least a portion of the auger 35 rotates in an eccentric manner, the rotating auger 35 vibrates. Thus, the auger 35 can convey the toner while shaking off the toner. Accordingly, it is possible to prevent the toner from getting stuck between adjacent teeth of the screw 40.

As a result, it is possible to prevent deterioration in the performance of the auger 35 conveying the toner.

As shown in FIG. 5B, the rotational centers A and B of the auger shafts 41 coincide with each other in the projection plane 88 in the width direction and are displaced from the center of gravity C of the auger main body 39. That is, since the center of gravity C of the auger main body 39 is at a position displaced from the rotation axis X of the auger 35, the auger main body 39 rotates in an eccentric manner as the auger 35 rotates.

As a result, it is possible to securely rotate the auger main body 39 in an eccentric manner.

In addition, since the auger 35, at least a portion of which rotates in an eccentric manner can suppress deterioration in the performance of conveying the toner, it is possible to supply the toner to the developing roller 37 in a secure manner.

As shown in FIG. 2, the process frame 22 includes the developing chamber 84 that receives the auger 35, and the process frame 22 supports the developing roller 37. The toner cartridge 31 includes the chamber 85 that accommodates the toner, and the toner cartridge 31 is detachable from the process frame 22. The toner accommodated in the chamber 85 is supplied to the developing chamber 84. Thus, the toner supplied from the chamber 85 is conveyed by the auger 35 received in the developing chamber 84 and is supplied to the developing roller 37. When the toner accommodated in the chamber 85 is used up, the toner cartridge 31 is replaced to continue to supply the toner to the developing chamber 84.

The developing chamber 84 is less spacious than the chamber 85. Accordingly, the auger 35 provided in the developing chamber 84 is smaller than the agitator 93 provided in the chamber 85. Thus, the gap between adjacent teeth of the screw 40 decreases, making the toner more likely to get stuck between the adjacent teeth of the screw 40. However, as described above and shown in FIG. 3, the frame-side supply opening 60 is a relatively small opening because the size in the width direction is smaller than the size of the supply roller 36 in the width direction. Accordingly, the toner supplied from the chamber 85 via the frame-side supply opening 60 is likely to get stuck within the developing chamber 84. However, by employing the auger 35 according to an illustrative aspect of the present invention, at least a portion of which rotates in an eccentric manner, it is possible to prevent the toner from getting stuck between the adjacent teeth of the screw 40.

Additional Illustrative Aspects

(1) First Modified Example

Figure 6A:
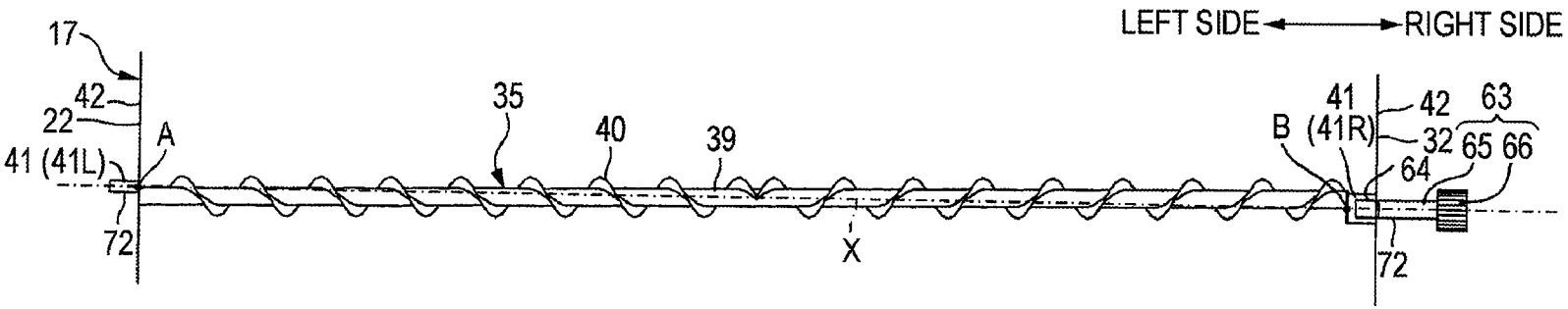
FIG. 6A is a schematic top view of the process side walls and the auger according to a first modified example.
Figure 6B:
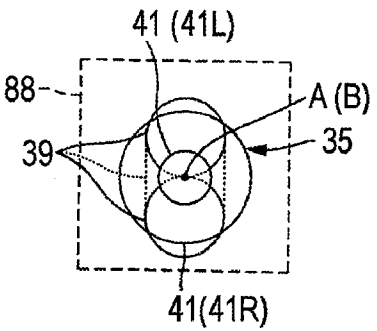
FIG. 6B is a projection view, projected in the width direction, of the auger shown in FIG. 6A.

FIG. 6A is a schematic top view of the process side walls 42 and the auger 35 according to a first modified example, and FIG. 6B is a projection view, projected in the width direction, of the auger 35 shown in FIG. 6A.

In the first modified example, in the projection plane 88, the rotational centers A and B of the auger shafts 41 coincide with each other (see FIG. 6B). The auger main body 39 extends along a straight line that connects the rotational centers A and B to each other; that is, the auger main body 39 extends along a line intersecting the rotation axis X (see FIG. 6A). Specifically, the auger main body 39 is connected to the auger shafts 41 with its circular centers at both ends in the width direction being disposed at positions displaced from the circular centers of the auger shafts 41. As can be seen from FIG. 6A, the left end of the auger main body 39 is connected to a portion of the left-side auger shaft 41L, the portion being off the rotational center A of the left-side auger shaft 41L (in the drawing, the portion is lower than the rotational center A). The right end of the auger main body 39 is connected to a portion of the right-side auger shaft 41R, the portion being off the rotational center B of the right-side auger shaft 41R (in the drawing, the portion is upper than the rotational center A). The auger main body 39 extends upward as it goes rightward, while intersecting the rotation axis X that extends in the width direction.

As the auger 35 rotates, the auger main body 39 rotates about the rotation axis X in an eccentric manner.

As a result, it is possible to securely rotate the auger main body 39 in an eccentric manner.

(2) Second Modified Example

Figures 7A, 7B:
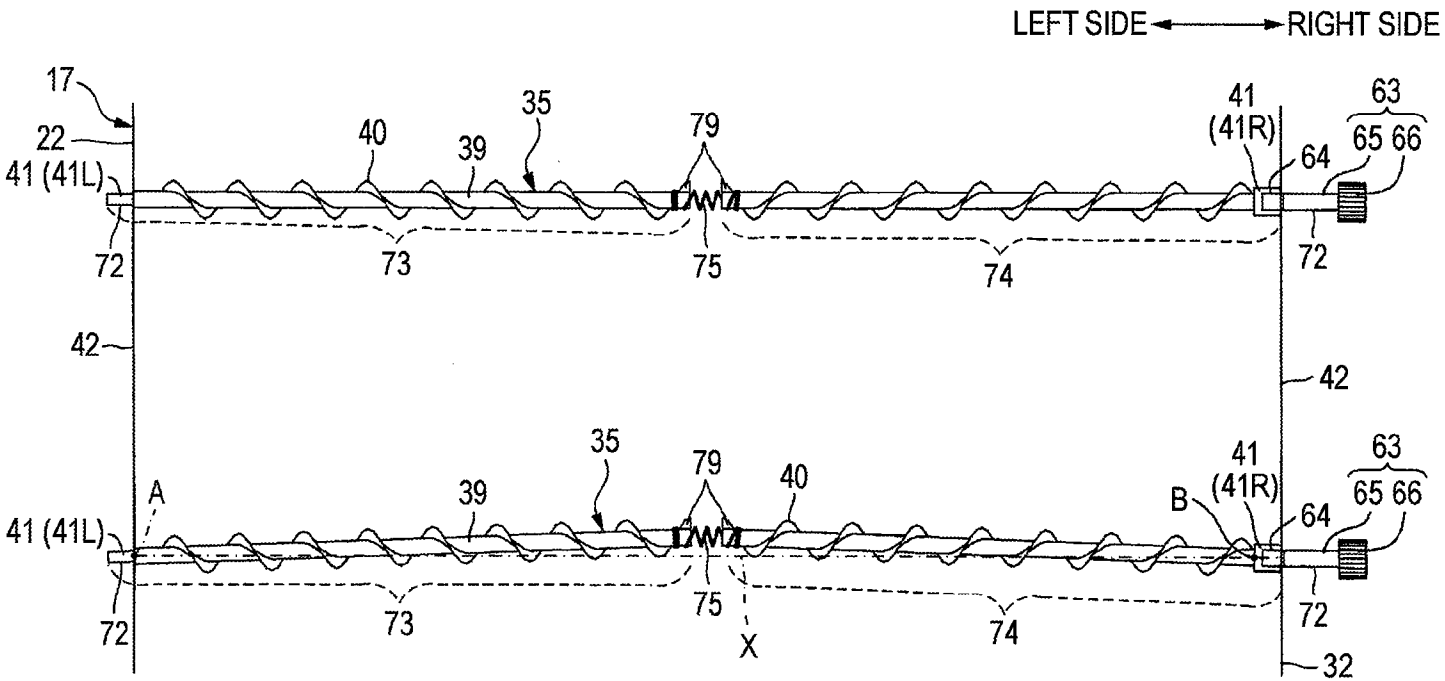
FIG. 7A is a schematic top view of the process side walls and the auger according to a second modified example, showing the state in which the auger is not rotating.
FIG. 7B is a schematic top view of the process side walls and the auger according to the second modified example, showing the state in which the auger is rotating.

FIG. 7A is a schematic top view of the process side walls 42 and the auger 35 according to a second modified example, showing the state in which the auger 35 is not rotating, and FIG. 7B is a schematic top view of the process side walls 42 and the auger 35 according to the second modified example, showing the state in which the auger 35 is rotating.

In the second modified example, as shown in FIG. 7A, the auger 35 is divided substantially at its center in the width direction into two division portions. The left half of the divided auger 35 will be referred to as a left-side division portion 73, and the right half will be referred to as a right-side division portion 74. A gap is defined between the right end portion of the left-side division portion 73 and the left end portion of the right-side division portion 74.

A coil spring 75 is inserted with one end of the coil spring 75 secured around the right end portion of the left-side division portion 73 and another end of the coil spring 75 secured around the left end portion of the right-side division portion 74 so that the left-side division portion 73 and the right-side division portion 74 adjacent to each other are connected by the coil spring 75. The coil spring 75 serves as an example of an elastic member. It is also possible to use a rubber section or other elastic material in place of the coil spring, the rubber section being secured to the division portions.

Since the end portions (hereinafter referred to as connecting portions 79) of the adjacent left-side division portion 73 and right-side division portion 74 connected by the coil spring 75 are at unstable positions, the end portions rotate in an eccentric manner as the auger 35 rotates.

Specifically, when the auger 35 rotates, as shown in FIG. 7B, the connecting portions 79 of the left-side division portion 73 and the right-side division portion 74 receive a centrifugal force and are thus displaced away from the rotation axis X so the connecting portions 79 rotate about the rotation axis X in an eccentric manner. Accordingly, when seen in a direction perpendicular to the width direction, the auger 35 is bent substantially in a V shape.

As a result, it is possible to securely rotate the connecting portions 79 in an eccentric manner.

Although the auger 35 is divided into two division portions of the left-side division portion 73 and the right-side division portion 74, the present inventive concept is not limited to this. The auger 35 may be divided into three or more division portions, with the division portions being connected by respective coil springs.

(3) Third Modified Example

Figures 8A, 8B:
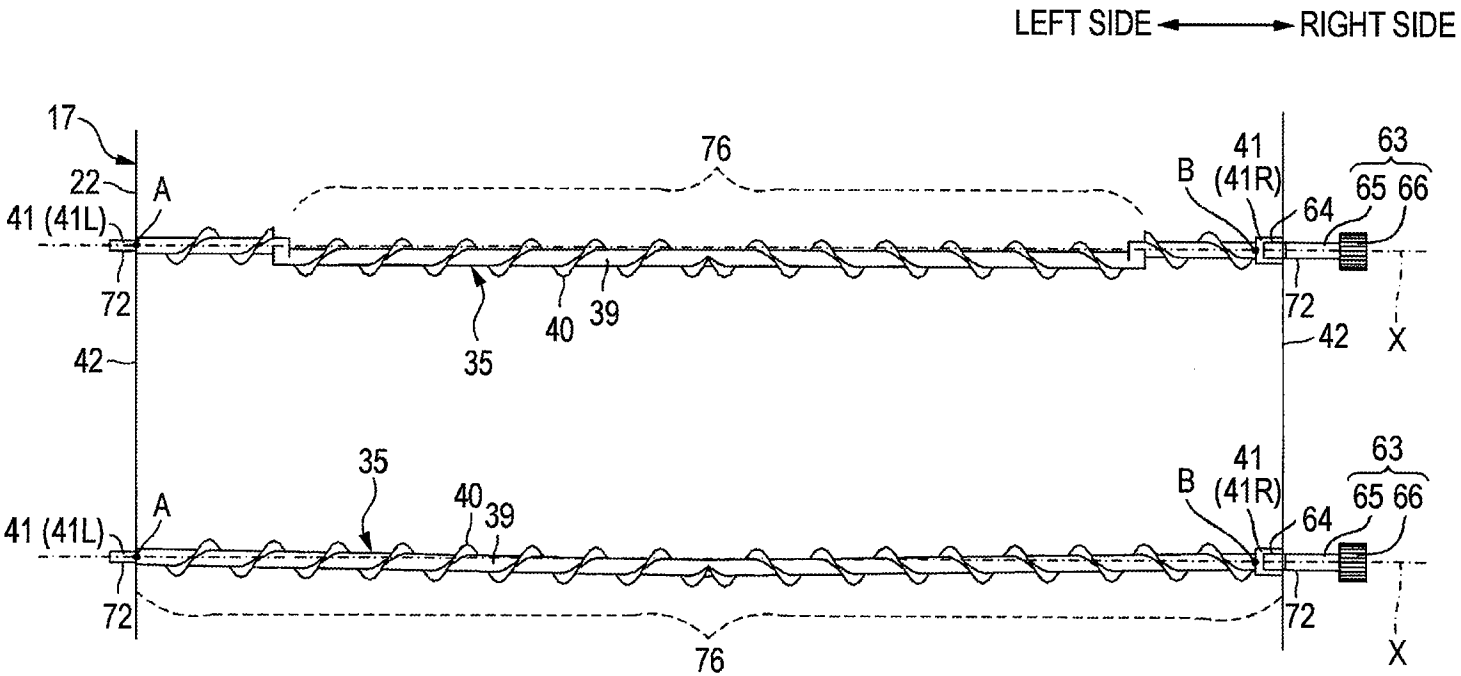
FIGS. 8A and 8B are schematic top views of the process side walls and the auger according to a third modified example.

FIGS. 8A and 8B are schematic top views of the process side walls 42 and the auger 35 according to a third modified example.

In the third modified example, as shown in FIGS. 8A and 8B, the auger main body 39 includes a bent portion 76. The bent portion 76 is bent so as to protrude in a direction intersecting the width direction between the left-side auger shaft 41L and the right-side auger shaft 41R. Specifically, when seen in a direction perpendicular to the width direction, the bent portion 76 is bent in a substantially U shape in FIG. 8A and is bent in a substantially V shape in FIG. 8B.

When the auger 35 rotates, the bent portion 76 rotates about the rotation axis X in an eccentric manner.

As a result, it is possible to securely rotate the bent portion 76 in an eccentric manner.

The bent portion 76 can be provided in a simple manner by bending the auger 35 in a substantially V shape so as to protrude in the direction intersecting the width direction (see FIG. 8A). The bent portion 76 can also be provided in a simple manner by bending the auger 35 in a substantially U shape so as to protrude in the direction intersecting the opposing direction (see FIG. 8B).

(4) Fourth Modified Example

Figures 9A, 9B:
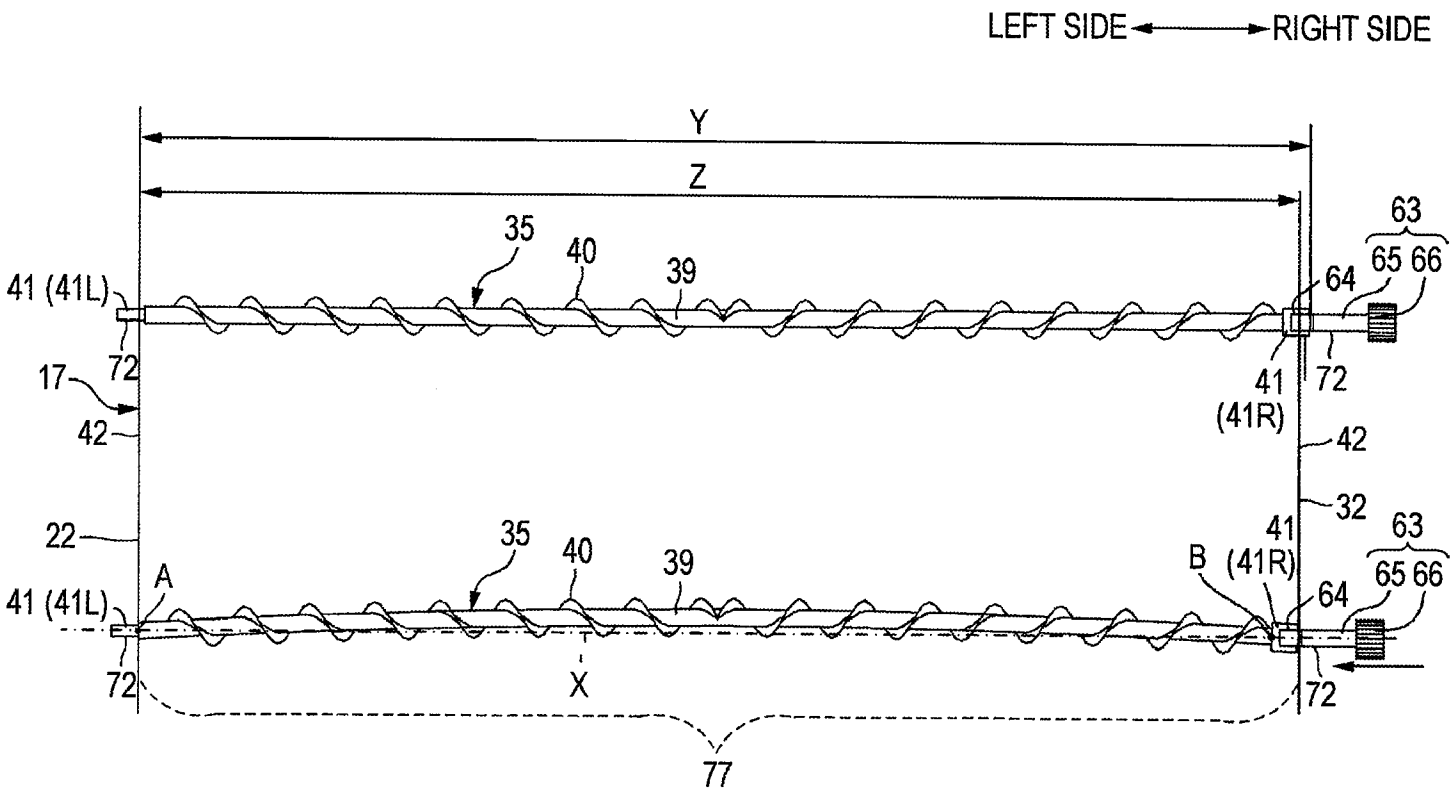
FIG. 9A is a schematic top view of the process side walls and the auger according to a fourth modified example, showing the state in which the auger is not yet attached to the process side walls.
FIG. 9B is a schematic top view of the process side walls and the auger according to the fourth modified example, showing the state in which the auger is attached to the process side walls.

FIG. 9A is a schematic top view of the process side walls 42 and the auger 35 according to a fourth modified example, showing the state in which the auger 35 is not yet attached to the process side walls 42, and FIG. 9B is a schematic top view of the process side walls 42 and the auger 35 according to the fourth modified example, showing the state in which the auger 35 is attached to the process side walls 42.

In the fourth modified example, as shown in FIG. 9A, the natural length Y of the auger main body 39 (including the right-side auger shaft 41R) in the opposing direction (the width direction) of the process side walls 42 is set longer than the above-described opposing gap Z of the pair of process side walls 42. Accordingly, when the auger 35 is attached to the process side walls 42, the auger main body 39 cannot extend straight in the width direction and is curved between the process side walls 42 (this curved portion is referred to as a curved portion 77). To provide a smooth curve profile to the auger main body 39, the surface of the right-side auger shaft 41R that makes contact with the right-side process side wall 42 has a substantially spherical shape.

When the auger 35 rotates, the curved portion 77 rotates about the rotation axis X in an eccentric manner.

As a result, it is possible to securely rotate the curved portion 77 in an eccentric manner.

By setting the natural length of the auger 35 being sandwiched between the process side walls 42 longer than the opposing gap Z, the curved portion 77 is provided. Although the right-side auger shaft 41R and the auger main body 39 are sandwiched between the process side walls 42, the present inventive concept is not limited to this. When only the auger main body 39 is sandwiched between the process side walls 42, the natural length of the auger main body 39 may be set longer than the opposing length Z.

(5) Fifth Modified Example

Figure 10A:
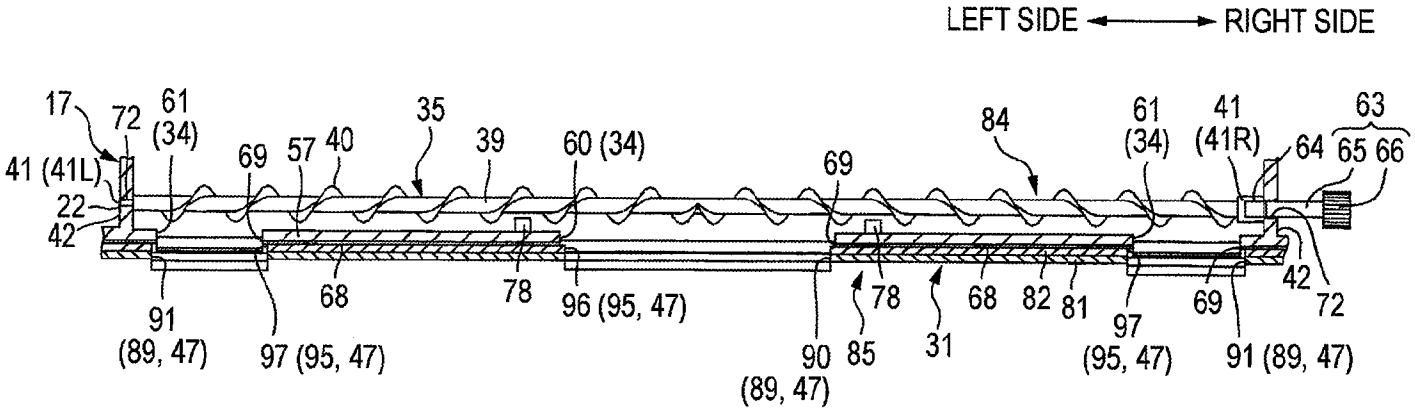
FIG. 10A is a schematic top view of a process frame and the auger according to a fifth modified example, showing the state in which abutting protrusions are displaced from a screw.
Figure 10B:
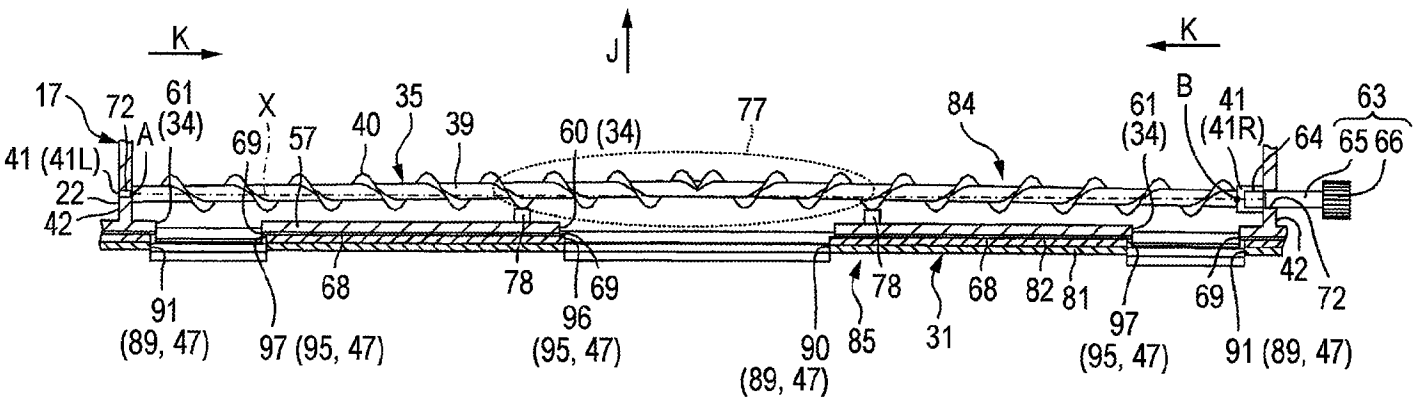
FIG. 10B is a schematic top view of the process frame and the auger according to the fifth modified example, showing the state in which the abutting protrusions make abutting contact with the screw.

FIG. 10A is a schematic top view of the process frame 22 and the auger 35 according to a fifth modified example, showing the state in which abutting protrusions 78 are displaced from the screw 40, and FIG. 10B is a schematic top view of the process frame 22 and the auger 35 according to the fifth modified example, showing the state in which the abutting protrusions 78 make abutting contact with the screw 40.

In the fifth modified example, as shown in FIG. 10A, the process frame 22, specifically the partition wall 57 includes abutting protrusions 78. The abutting protrusions 78 protrude from the partition wall 57 toward the screw 40 of the auger 35. The end portions of the abutting portions 78 on the downstream side in the protruding direction are within the range of the rotation trajectory of the screw 40.

Accordingly, when the auger 35 rotates, as shown in FIG. 10B, the abutting protrusions 78 make abutting contact with the screw 40 in the rotation direction (i.e., a direction perpendicular to the rotation axis X) of the auger 35 on an intermittent basis. Specifically, the state in which the abutting protrusions 78 are in abutting contact with the screw 40 (see FIG. 10B) and the state in which the abutting protrusions 78 are displaced from the screw 40 (see FIG. 10A) alternate with each other. Thus, the auger 35 is deformed so as to be curved in the direction of the arrow J so the above-described curved portions 77 are formed on an intermittent basis. That is, the auger 35 rotates about the rotation axis X in an eccentric manner during its rotation when the abutting protrusions 78 make abutting contact with the screw 40 on a periodic basis. In addition, when the auger 35 rotates in an eccentric manner, both ends thereof in the width direction are moved in the direction of the arrow K in a sliding manner.

As a result, it is possible to securely rotate the auger 35 in an eccentric manner. In addition, it is possible to generate vibration by the abutting contact between the auger 35 and the abutting protrusions 78.

(6) Additional Modified Examples

The above-described aspects may be combined with each other. Accordingly, it is possible to securely allow the auger 35 to rotate in an eccentric manner and to thus prevent deterioration of the performance of the auger 35 conveying the toner in a more efficient manner. Although the auger 35 is provided in the process frame 22, the auger 35 according to an illustrative aspect of the present invention may be also provided in the chamber 85 of the toner cartridge 31. In this case, the auger 35 conveys the toner in the width direction in the chamber 85, and the agitator 93 conveys the toner in a direction (the circumferential direction and the radial direction) intersecting the width direction.

Further, in the above-described illustrative aspects, the cartridge 17 integrally includes the photosensitive drum 25 and the developing roller 37, and the cartridge 17 is detachably attached to the body casing 2. However, for example, the cartridge 17 may additionally be configured as a developing cartridge that does not include the photosensitive drum 25, and an additional unit (a drum cartridge) that includes the photosensitive drum 25 may be provided, so the developing cartridge can be detachably attached to the drum cartridge.

The photosensitive drum 25, the scorotron-type charger 26, and the transfer roller 28 may be provided in the body casing 2 so that the developing cartridge can be detachably attached to the body casing 2.

Still further, although illustrative aspects of the present inventive concept have been described in relation to a laser printer, the present inventive concept is not limited to any specific type of laser printer. Rather, the present inventive concept can be applied to a monochrome or a color laser printer, including a tandem type and an intermediate transfer type printer.

While the present inventive concept has been shown and described with reference to certain illustrative aspects thereof, it will be understood by those skilled in the art that various changes in form and details may be made therein without departing from the spirit and scope of the invention as defined by the appended claims.

What is claimed is:

1. A cartridge comprising:

a housing that is capable of accommodating developer and that has a pair of supporting members confronting each other in a facing direction with a gap formed therebetween; and a conveying member provided in the housing, at least a portion of the conveying member rotating in an eccentric manner, the conveying member comprising:

a main body portion disposed along the facing direction;

a pair of supported portions that are provided at both ends of the main body portion in the facing direction and are rotatably supported by the supporting members; and a spiral blade portion that is provided on the main body portion and that conveys the developer in outward directions toward both of the supporting members of the housing.

2. The cartridge according to claim 1, wherein, in a projection plane in the facing direction, rotational centers of the supported portions coincide with each other and are displaced from a center of gravity of the main body portion.

3. The cartridge according to claim 1, wherein, in a projection plane in the facing direction, rotational centers of the supported portions coincide with each other, and the main body portion extends in a direction intersecting a straight line that connects the rotational center of the supported portion at one side and the rotational center of the supported portion at the other side.

4. The cartridge according to claim 1, wherein the conveying member is divided in the facing direction into a plurality of division portions, and wherein adjacent division portions are connected to each other by an elastic member.

5. The cartridge according to claim 1, wherein the conveying member comprises a bent portion that is located between the supported portion at one side and the supported portion at the other side, the bent portion being bent in a direction intersecting the facing direction.

6. The cartridge according to claim 5, wherein the bent portion is bent in a substantially V shape so as to protrude in the direction intersecting the facing direction.

7. The cartridge according to claim 5, wherein the bent portion is bent in a substantially U shape so as to protrude in the direction intersecting the facing direction.

8. The cartridge according to claim 1, wherein a length of the main body portion in the facing direction is set longer than the gap between the supporting members.

9. The cartridge according to claim 1, wherein the housing comprises a protrusion that extends towards the blade portions such that the protrusion contacts the blade portions on an intermittent basis as the conveying member is rotated.

10. The cartridge according to claim 1, further comprising:

a photosensitive member; and a developer carrying member that is supported by the housing and is capable of supplying the developer to the photosensitive member, wherein the conveying member supplies the developer to the developer carrying member.

11. The cartridge according to claim 10, wherein the housing comprises:

a first housing comprising a first chamber that accommodates the conveying member, the first housing supporting the developer carrying member; and a second housing comprising a second chamber that accommodates the developer, the second housing being detachable from the first housing, wherein the developer accommodated in the second chamber is supplied to the first chamber, and wherein a volume of the first chamber is less than a volume of the second chamber.

12. An image forming apparatus, comprising:

an image forming apparatus main body; and a cartridge insertable into the image forming apparatus main body, the cartridge comprising:

a housing that is capable of accommodating developer and that has a pair of supporting members confronting each other in a facing direction with a gap formed therebetween; and a conveying member provided in the housing, at least a portion of the conveying member rotating in an eccentric manner, the conveying member comprising:

a main body portion disposed along the facing direction;

a pair of supported portions that are provided at both ends of the main body portion in the facing direction and are rotatably supported by the supporting members; and a spiral blade portion that is provided on the main body portion and that conveys the developer in outward directions toward both of the supporting members of the housing.

13. The cartridge according to claim 1, wherein the spiral blade portion has a first winding direction and a second winding direction that is reversed from the first winding direction.

14. The cartridge according to claim 13, wherein the winding direction of the spiral blade is reversed from the first winding direction to the second winding direction at a center portion of the conveying member.

15. The image forming apparatus according to claim 12, wherein the spiral blade portion has a first winding direction and a second winding direction that is reversed from the first winding direction.

16. The image forming apparatus according to claim 15, wherein the winding direction of the spiral blade is revered from the first winding direction to the second winding direction at a center portion of the conveying member.

* * * * *